US010046442B2

(12) United States Patent
Sakamoto

(10) Patent No.: US 10,046,442 B2
(45) Date of Patent: Aug. 14, 2018

(54) VEHICLE BODY MANUFACTURING APPARATUS

(71) Applicant: Fuji Jukogyo Kabushiki Kaisha, Tokyo (JP)

(72) Inventor: Noboru Sakamoto, Tokyo (JP)

(73) Assignee: SUBARU CORPORATION, Tokyo (JP)

( * ) Notice: Subject to any disclaimer, the term of this patent is extended or adjusted under 35 U.S.C. 154(b) by 29 days.

(21) Appl. No.: 14/845,145

(22) Filed: Sep. 3, 2015

(65) Prior Publication Data

US 2016/0068209 A1 Mar. 10, 2016

(30) Foreign Application Priority Data

Sep. 4, 2014 (JP) ..... 2014-180551

(51) Int. Cl.
*B25B 27/14* (2006.01)
*B25B 11/02* (2006.01)

(52) U.S. Cl.
CPC ..... *B25B 11/02* (2013.01)

(58) Field of Classification Search
CPC ..... B25B 11/02
USPC ..... 29/897.2, 464, 559
See application file for complete search history.

(56) References Cited

U.S. PATENT DOCUMENTS

2008/0000068 A1* 1/2008 Savoy ..... B23P 21/004 29/429
2013/0113149 A1* 5/2013 Yeum ..... B23K 37/0443 269/59

FOREIGN PATENT DOCUMENTS

JP S 64-011078 A 1/1989
JP H 02-144267 A 6/1990
JP 2003-146265 A 5/2003

OTHER PUBLICATIONS

JPO Notification of Reasons for Refusal dated Aug. 25, 2015 and Decision of Grant dated Jan. 19, 2016.

* cited by examiner

*Primary Examiner* — David Bryant
*Assistant Examiner* — Nirvana Deonauth
(74) *Attorney, Agent, or Firm* — McGinn I.P. Law Group, PLLC.

(57) ABSTRACT

A vehicle body manufacturing apparatus includes a left side jig configured to be disposed on a left lateral side of a vehicle body, and a right side jig configured to be disposed on a right lateral side of the vehicle body. The left side jig is formed to be divided into a left front jig on a front side and a left rear jig on a rear side, and the right side jig is formed to be divided into a right front jig on a front side and a right rear jig on a rear side. The left side jig and the right side jig performs clamping for positioning and pre-assembling by coming into contact with the vehicle body from the outside of the vehicle body as well as clamping for positioning and pre-assembling by extending into the inside of the vehicle body.

4 Claims, 8 Drawing Sheets

VEHICLE BODY MANUFACTURING APPARATUS

CROSS-REFERENCE TO RELATED APPLICATIONS

The present application claims priority from Japanese Patent Application No. 2014-180551 filed on Sep. 4, 2014, the entire contents of which are hereby incorporated by reference.

BACKGROUND

1. Technical Field

The present invention relates to a vehicle body manufacturing apparatus that positions and pre-assembles a vehicle body with jigs disposed on right and left lateral sides.

2. Related Art

In related art, when a vehicle body is positioned and pre-assembled, jigs are disposed on the right and left lateral sides of the vehicle body and the positioning and pre-assembling are performed using the jigs. For instance, Japanese Unexamined Patent Application Publication (JP-A) No. 2-144267 discloses a technique of an assembly method for an automobile vehicle body, in which a floor body member, which is set to an underfloor jig in a floor body set process, is transported to a first temporarily attaching process along with the underfloor jig, side body members set to a pair of side body jigs, and a floor body member are positioned and temporarily attached by combining corresponding jigs in the first temporarily attaching process, subsequently, the temporarily attached floor body member and side body members along with setting jigs are transported to a second temporarily attaching process, other constituent parts are temporarily attached to the temporarily attached floor body member and side body members in the second temporarily attaching process, and subsequently, the side body members are separated from a temporarily attached and assembled main body and the temporarily attached and assembled main body along with the underfloor jig are transported to an additional welding process.

However, when a pair of right and left side body members is held by a pair of dedicated jigs to the floor body member which is set to the underfloor jig, and the body member set from upward is further positioned by the dedicated jigs so as to surround the vehicle body and the main body is assembled by spot welding as in the technique of assembly method for an automobile vehicle body disclosed in JP-A No. 2-144267, for production of vehicles with a plurality of vehicle shapes and vehicle types in the same assembly line, a great number of large-sized dedicated jigs are needed according to the vehicle shapes and vehicle types of the vehicles to be assembled. In addition, because a needed jig is selected from a jig storage provided on the side of the line and used, a large work space is needed.

SUMMARY OF THE INVENTION

The present invention has been made in view of the above-described situation and provides a vehicle body manufacturing apparatus capable of reducing the size of jig, achieving commonality of jig to be used according to a vehicle shape and a vehicle type as much as possible, reducing the space for preparing jigs as much as possible, ensuring a large work space, and efficiently pre-assembling a vehicle body.

An aspect of the present invention provides a vehicle body manufacturing apparatus including: a left side jig configured to be disposed on a left lateral side of a vehicle body; and a right side jig configured to be disposed on a right lateral side of the vehicle body. The vehicle body manufacturing apparatus positions and pre-assembles the vehicle body using at least the left side jig and the right side jig, and the left side jig is formed to be divided into a left front jig on a front side and a left rear jig on a rear side, and the right side jig is formed to be divided into a right front jig on a front side and a right rear jig on a rear side.

DETAILED DESCRIPTION

Hereinafter, implementations of the present invention will be described with reference to the drawings.

First Implementation

Figure 1:
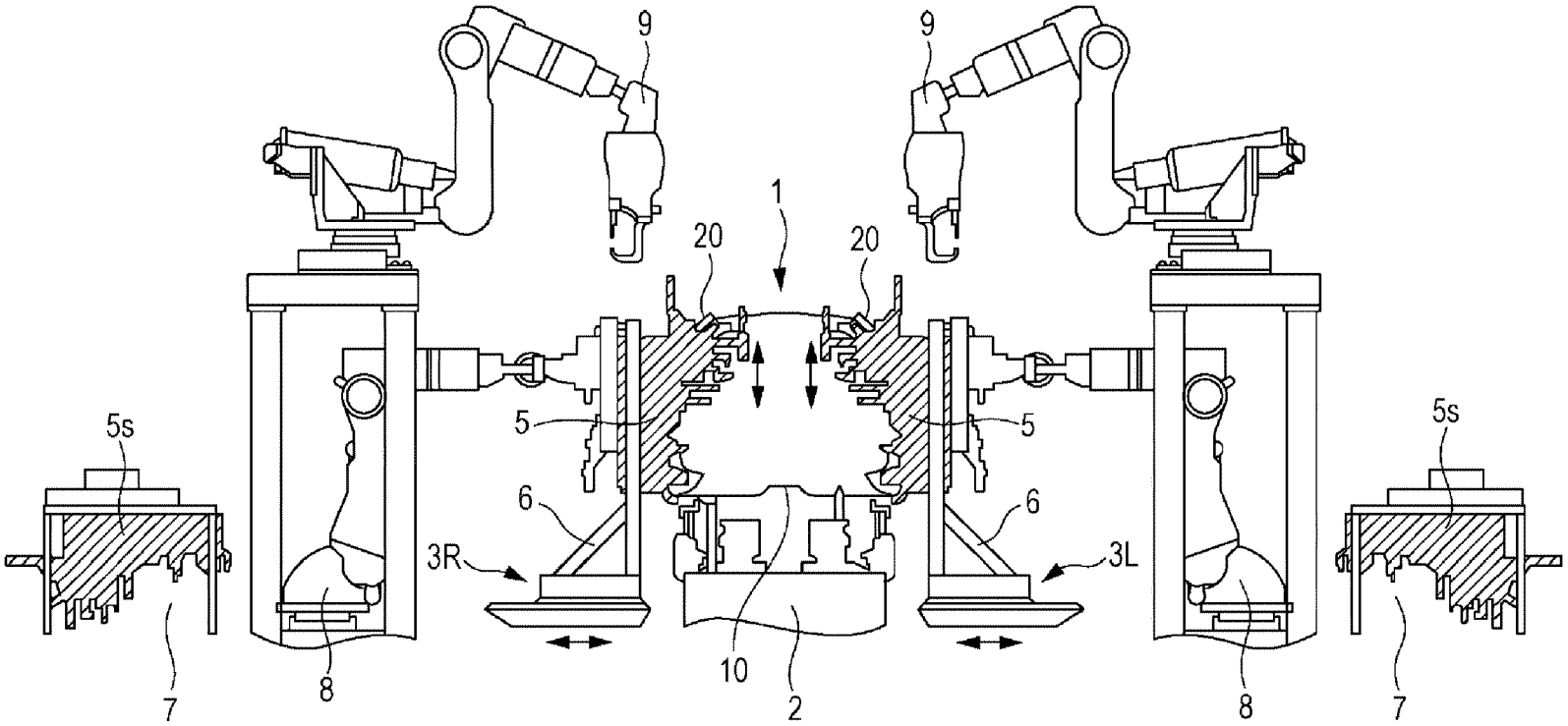
FIG. 1 is a schematic front view of a stage of a vehicle main body assembly process according to a first implementation of the present invention.
Figure 2:
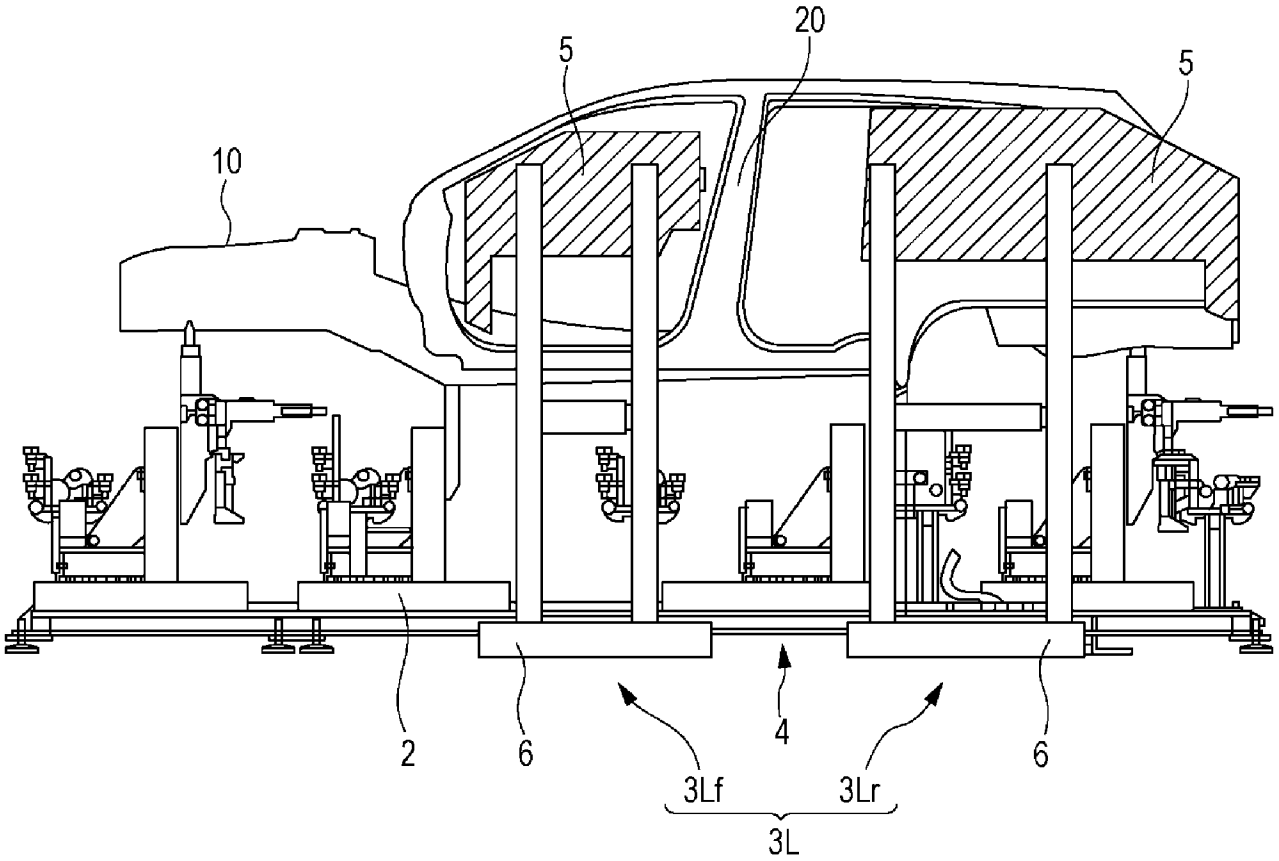
FIG. 2 is a schematic side view of the stage of the vehicle main body assembly process according to the first implementation of the present invention.

FIG. 1 and FIG. 2 illustrate a vehicle main body assembly process. On a stage of the main body assembly process, a vehicle body 1 is fixedly installed on an underfloor jig 2 and is transported in by a shuttle conveyer (not illustrated) or the like, the vehicle body 1 in which a side structure 20 that is a side structural part is temporarily fixed to each of both sides of a center structure 10 that is a lower central structural part.

The center structure 10 includes, for instance, a front wheel apron, a toe board, a front floor, a rear floor, and a rear wheel apron. The side structure 20 includes, for instance, a front pillar, a center pillar, a rear quarter, a side rail, and a side sill.

On the stage of the assembly process, the right and left sides of the vehicle body 1 fixedly installed on the underfloor jig 2 are provided with a left side jig 3L and a right side jig 3R, respectively.

The left side jig 3L is formed to be divided into a left front side jig 3Lf on the front side and a left rear side jig 3Lr on the rear side, and a space 4 is ensured between the left front side jig 3Lf and the left rear side jig 3Lr (see FIG. 2).

Similarly, the right side jig 3R is formed to be divided into a right front side jig 3Rf on the front side and a right rear side jig 3Rr on the rear side, and a space 4 is ensured between the left front side jig 3Rf and the left rear side jig 3Rr.

The left front, left rear, right front, right rear side jigs 3Lf, 3Lr and 3Rf, 3Rr come into contact with portions (the portions at left front, left rear, right front, right rear) of the transported vehicle body 1, the portions facing respective jigs. The gigs mainly include side body jigs 5 each serving as a receiving unit that positions and pre-assembles needed parts, and side body jig fixing parts 6 that each fix corresponding one of the side body jigs 5 and are movable closer to and away from the vehicle body 1. That is, each of the side body jig fixing parts 6 is a movable jig such that when the vehicle body 1 is transported to the stage or transported out from the stage, the side body jig fixing part 6 moves the side body jig 5 away from the vehicle body 1, whereas when positioning and pre-assembly are performed using the side body jig 5 in the assembly process, the side body jig fixing part 6 moves the side body jig 5 closer to the vehicle body 1.

The parts to be positioned and pre-assembled by the left side jig 3L and the right side jig 3R include, in addition to the parts included in the above-mentioned side structure 20, a front rail and a duct combination that connect the right and left front pillars installed in a vehicle width direction of the vehicle body, a brace center that connects the upper ends of the right and left center pillars, a rear rail that connects the upper ends of the right and left rear quarters, a rear skirt, and a rear panel.

The left side jig 3L and the right side jig 3R are capable of coming into contact with those parts from the outside of the vehicle body 1 to clamp for positioning and pre-assembling with an external clamp 5*a*, as well as of extending inwardly of the vehicle body 1 through the side door section of the vehicle body 1 to clamp for positioning and pre-assembling with an internal clamp 5*b* from the inside of the vehicle body 1.

Figure 4:
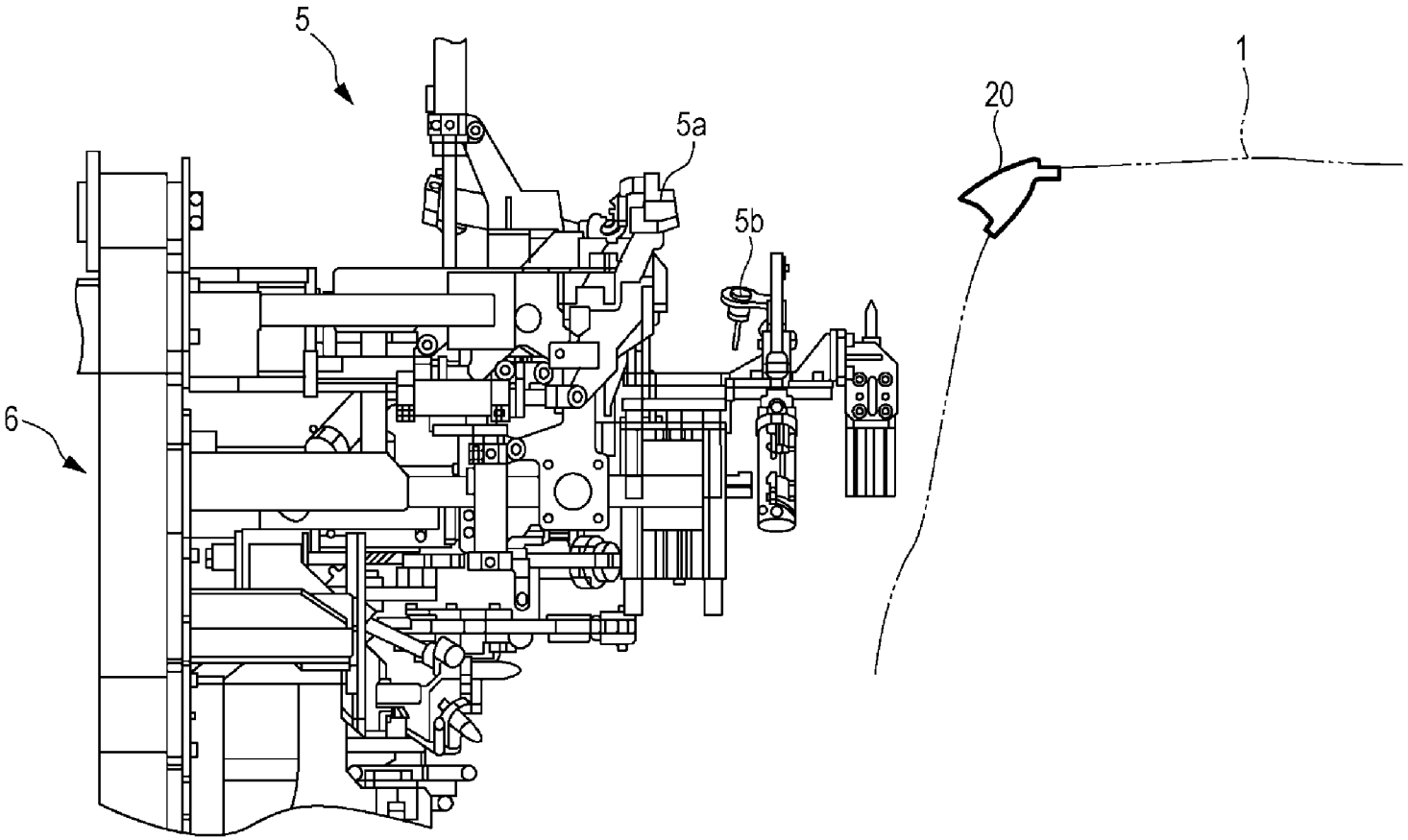
FIG. 4 illustrates a state of a side body jig before the side body jig extends into the vehicle body, according to the first implementation of the present invention.

Specifically, as illustrated in FIG. 4, when the vehicle body 1 is transported to the stage of the assembly process, each side body jig fixing part 6 of the left side jig 3L and the right side jig 3R is at a retreated position and each side body jig 5 is away from the vehicle body 1.

Figure 5:
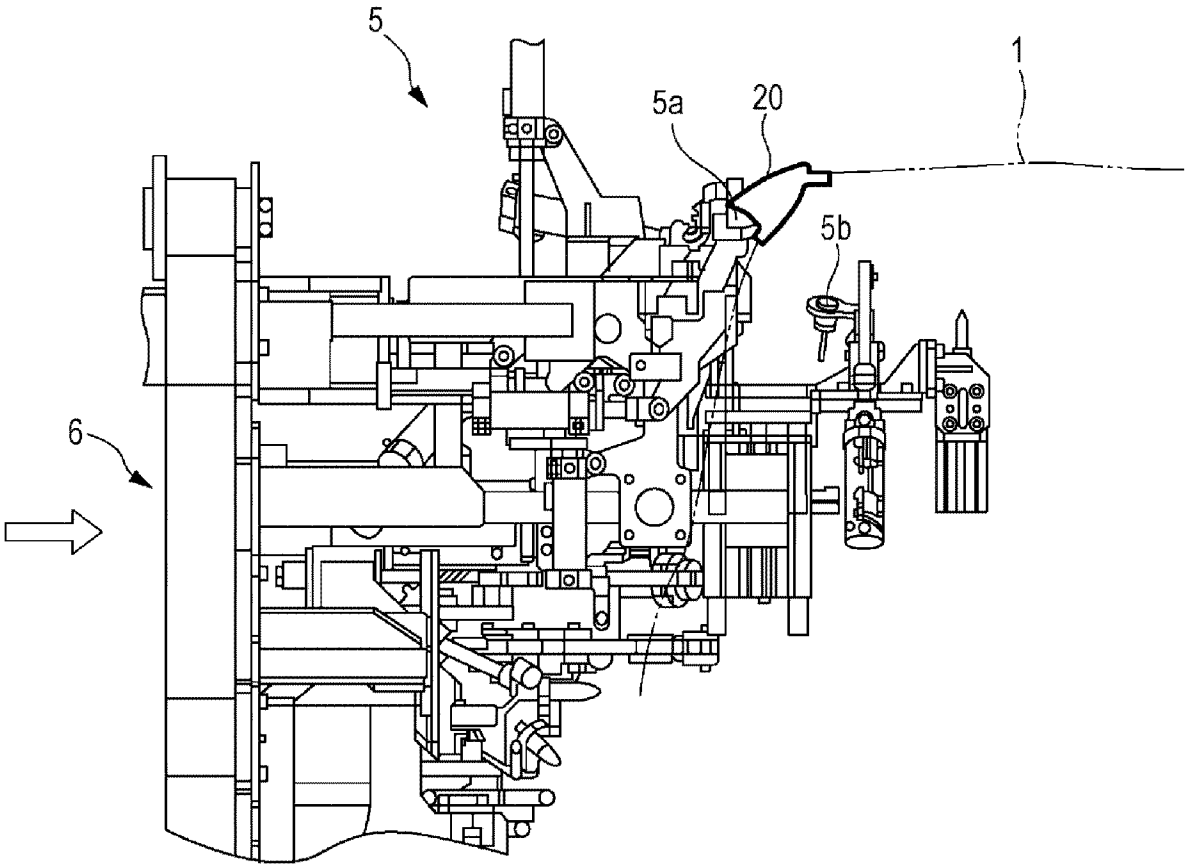
FIG. 5 illustrates a state of a side body jig after the side body jig extends into the vehicle body and clamps a side rail lateral side, according to the first implementation of the present invention.

When the assembly process starts, as illustrated in FIG. 5, the side body jig fixing part 6 moves forward to the vehicle body 1 and a portion of the outer side (for instance, a work on the lateral side of the side rail) of the vehicle body 1 comes into contact with the external clamp 5*a* of the side body jig 5 and is clamped. Along with the forward movement of the side body jig fixing part 6, the internal clamp 5*b* of the side body jig 5 extends inwardly of the vehicle body 1 through the side door section or the like of the vehicle body 1.

Figure 6:
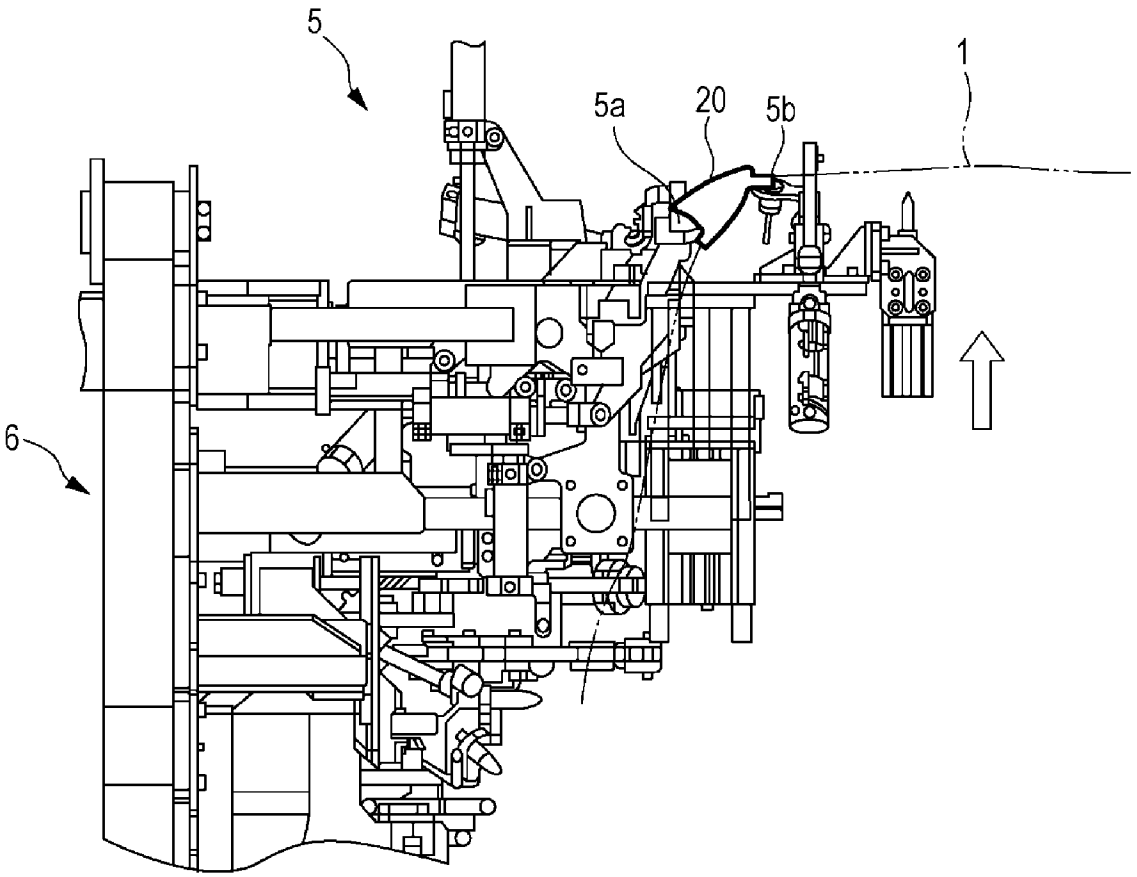
FIG. 6 illustrates a state of a side body jig after the side body jig extends into the vehicle body and clamps a side rail roof portion, according to the first implementation of the present invention.

Subsequently, as illustrated in FIG. 6, the extended internal clamp 5*b* of the side body jig 5 performs a predetermined operation such as raising and is capable of clamping a predetermined portion (for instance, a work on the lateral side of the side rail) of the vehicle body 1 for positioning and pre-assembling from the inside of the vehicle body 1.

It is to be noted that in FIGS. 4 to 6, the side rail is illustrated as an example of the work in order to facilitate understanding. However, the implementation is similarly applicable to a front rail, a duct combination, a brace center, a rear rail, and other parts installed in the vehicle width direction of the vehicle body.

In addition, each side body jig 5 of the left side jig 3L and the right side jig 3R is replaceable, that is, removable from and mountable on the side body jig fixing part 6.

On the stage of the assembly process, other side body jigs 5*s* according to a vehicle type, a vehicle shape of the vehicle 1 which is produced in this line are disposed and prepared in respective side body jig storages 7.

Replacement work between each side body jig 5 and a side body jig 5*s* of interest is performed by a side body jig change robot 8.

It is to be noted that each symbol 9 in FIG. 1 indicates a spot welding robot that performs spot welding in the assembly process.

Figure 3:
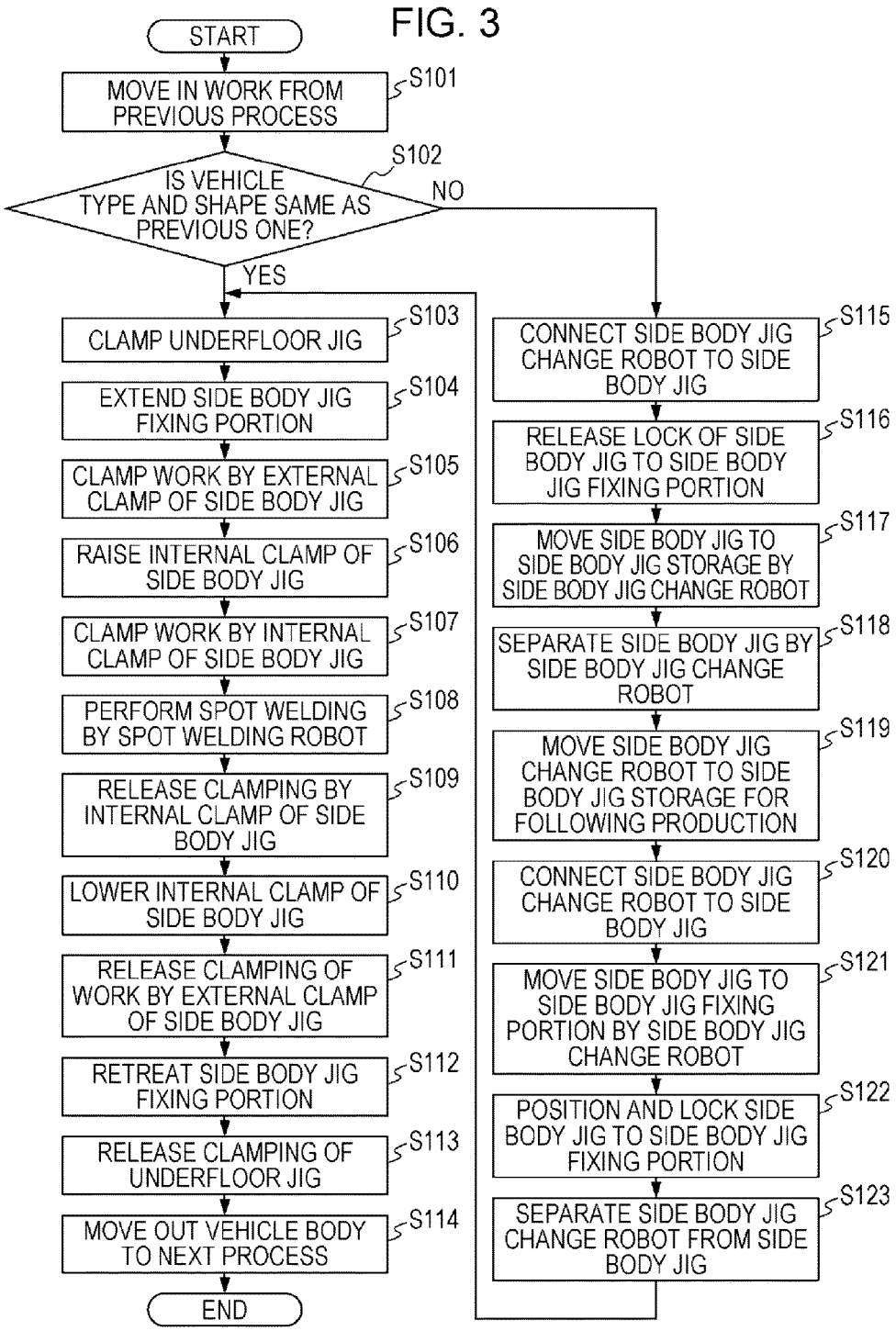
FIG. 3 is a flow chart of the vehicle main body assembly process according to the first implementation of the present invention.

Next, the vehicle main body assembly process by the present vehicle body manufacturing apparatus will be described with reference to the flow chart of FIG. 3.

First, in Step (hereinafter abbreviated as "S") 101, a work (the vehicle body 1 placed on the underfloor jig 2) is transported by, for instance, a shuttle conveyor from the previous process.

Next, the flow proceeds to S102 to determine whether or not the vehicle type and vehicle shape are same as those in the last assembly work. When the vehicle type and vehicle shape are same, the flow proceeds to S103 to fix the underfloor jig 2.

Subsequently, the flow proceeds to S104 where the side body jig fixing part 6 is extended toward the vehicle body 1.

Next, the flow proceeds to S105 where the external clamp 5*a* of the side body jig 5 clamps a work (for instance, a side rail) (see FIG. 5).

Subsequently, the flow proceed to S106 where the external clamp 5*a* raises the internal clamp 5*b* of the side body jig 5, which has extended into the vehicle body 1 through the side door section or the like of the vehicle body 1 in S104 and S105 described above, and the flow proceeds to S107 where the internal clamp 5*b* of the side body jig 5 clamps a work (for instance, side rail) (see FIG. 6).

Then, the flow proceeds to S108 where spot welding is performed on a predetermined portion of the work by a spot welding robot 9.

Subsequently, the flow proceeds to S109 where the clamping of the work by the internal clamp 5*b* of the side body jig 5 is released.

Subsequently, the flow proceeds to S110 where the internal clamp 5*b* of the side body jig 5 is lowered.

Subsequently, the flow proceeds to S111 where the clamping of the work by the external clamp 5*a* of the side body jig 5 is released.

Subsequently, the flow proceeds to S112 where the side body jig fixing part 6 is retreated from the vehicle body 1 and the internal clamp 5*b* of the side body jig 5, which has extended into the vehicle body 1, is removed from the inside of the vehicle body 1 and the side body jig 5 and the vehicle body 1 are spaced away to have a sufficient space therebetween.

The flow then proceeds to S113 where the clamping of the underfloor jig 2 is released, and the flow then proceeds to S114 where the vehicle body 1 placed on the underfloor jig 2 is transported by a shuttle conveyor or the like to the next process.

On the other hand, when the vehicle type and vehicle shape are determined to be different from those in the last assembly work in S102 described above, the flow proceeds to S115.

In S115, the side body jig change robot 8 is connected to the side body jig 5 that is currently fixed to the side body jig fixing part 6.

Subsequently, the flow proceeds to S116 where the fixation of the side body jig 5 to the side body jig fixing part 6 is released.

Subsequently, the flow proceeds to S117 where the side body jig change robot 8 moves the connected side body jig 5 to the side body jig storage 7 to place the side body jig 5 at a predetermined storage location.

Subsequently, the flow proceeds to S118 where the side body jig change robot 8 is detached from the moved side body jig 5.

Subsequently, the flow proceeds to S119 where the side body jig change robot 8 is moved to the side body jig storage 7, which stores another side body jig 5*s* that is prepared according to a production plan.

Subsequently, the flow proceeds to S120 where the side body jig change robot 8 is connected to the next side body jig 5*s*.

Subsequently, the flow proceeds to S121 where the side body jig change robot 8 moves the next side body jig 5*s* to the side body jig fixing part 6.

Subsequently, the flow proceeds to S122 where another side body jig 5*s* is fixed to the side body jig fixing part 6 (as the side body jig 5*s* for this time).

The flow then proceeds to S123 where the side body jig change robot 8 is detached from the newly fixed side body jig 5.

Subsequently, the processing in the above-described S103 and after is repeated.

As described above, according to the implementation of the present invention, the left side jig 3L of the stage of the assembly process is formed to be divided into the left front side jig 3Lf on the front side and the left rear side jig 3Lr on the rear side, and the right side jig 3R of the stage of the assembly process is formed to be divided into the right front side jig 3Rf on the front side and the right rear side jig 3Rr on the rear side.

Accordingly, a large-sized side jig that covers the entire left side or the entire right side of the vehicle body 1 is unnecessary, and the size reduction of the side jig may be achieved. In addition, even with varied wheel base and vehicle length depending on the vehicle type and vehicle shape, when the same left front, left rear, right front, and right rear sections are used in common, common jigs may be utilized. Since it is possible to achieve size reduction and commonality of jigs, the number of jigs to be prepared for each vehicle type and vehicle shape may be reduced, and a large work space may be ensured and pre-assembly of the vehicle body 1 may be efficiently made.

In addition, according to the present implementation, the left side jig 3L and the right side jig 3R are capable of clamping for positioning and pre-assembling by coming into contact from the outside of the vehicle body 1 as well as clamping for positioning and pre-assembling by extending into the inside of the vehicle body 1. Thus, an upper jig, which is configured to be disposed at a position above the roof of the vehicle body 1, is unnecessary. Therefore, an upper space which has been difficult to be used due to the presence of the upper jig, that is, wide spaces between the left side jig 3L and the right side jig 3R, between the left front side jig 3Lf and the left rear side jig 3Lr, and between the right front side jig 3Rf and the right rear side jig 3Rr, may be utilized to perform welding work and others efficiently and accurately.

Second Implementation

Figure 7:
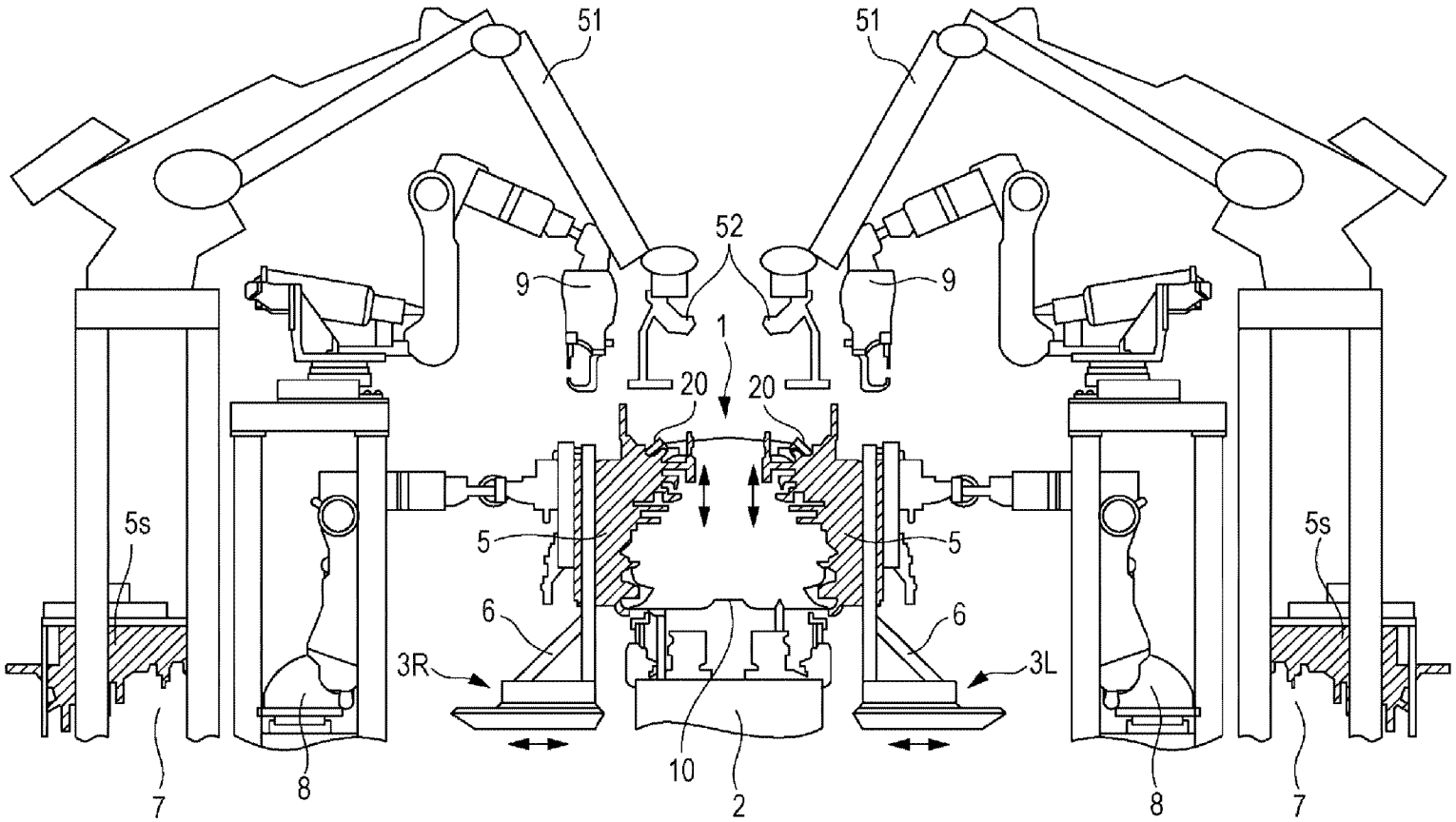
FIG. 7 is a schematic front view of a stage of a vehicle main body assembly process according to a second implementation of the present invention.
Figure 8:
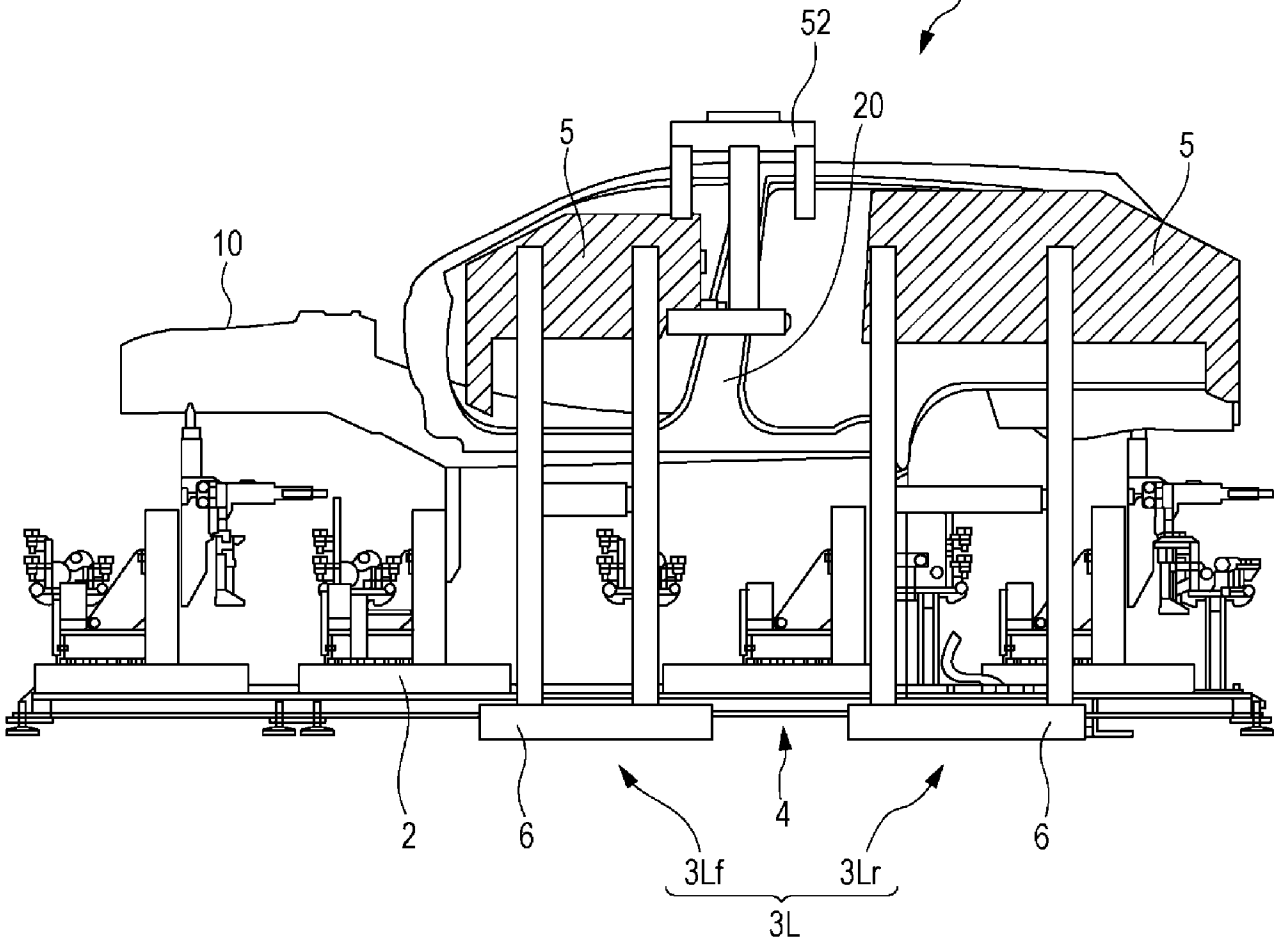
FIG. 8 is a schematic side view of the stage of the vehicle main body assembly process according to the second implementation of the present invention.

FIGS. 7 and 8 illustrate a vehicle main body assembly process according to a second implementation of the present invention. FIGS. 7 and 8 respectively correspond to FIGS. 1 and 2 in the first implementation. It is to be noted that the second implementation differs from the first implementation in that on the stage of the assembly process, the vehicle body 1, in which the inner parts of the side structures 20 are pre-assembled on both sides of the center structure 10, is fixedly installed on the underfloor jig 2 and is transported by a shuttle conveyor or the like, and the outer parts of the side structures 20 and other parts are both assembled to the vehicle body 1 in the assembly process. Other components and operation effects are the same as those in the first implementation, and thus the same components are denoted by the same symbols and description is omitted.

The stage of the main body assembly process according to the second implementation is provided with each robot described in the first implementation as well as outer part transport robots 51 that transport the respective outer parts of the side structures 20 on both right and left sides. The end of each of the outer part transport robots 51 is provided with, for instance, a hook-shaped hand part 52 that holds the outer parts.

The outer part transport robots 51 use the wide spaces between the left side jig 3L and the right side jig 3R, between the left front side jig 3Lf and the left rear side jig 3Lr, and between the right front side jig 3Rf and the right rear side jig 3Rr to transport outer parts of interest and perform positioning and pre-assembling of these parts. Needless to say, when the outer parts are pre-assembled, each robot is operated according to a predetermined program that is different from a program for pre-assembling the inner parts (for instance, with a different movement distance of the side body jig fixing part 6).

As indicated in the second implementation, even the outer parts and the inner parts of the vehicle body 1 are to be pre-assembled in a process, the process may be performed on the same stage rather than different stages, and thus the production line may be reduced.

The invention claimed is:

1. A vehicle body manufacturing apparatus comprising:

a left side jig configured to be disposed on a left lateral side of a vehicle body; and a right side jig configured to be disposed on a right lateral side of the vehicle body, wherein the vehicle body manufacturing apparatus positions and pre-assembles the vehicle body using at least the left side jig and the right side jig, the left side jig consists of a left front jig on a front side fixed by a left front side body jig fixing part which is movable closer to and away from the vehicle body and a left rear jig on a rear side fixed by a left rear side body jig fixing part which is movable closer to and away from the vehicle body, and the right side jig consists of a right front jig on a front side fixed by a right front side body jig fixing part which is movable closer to and away from the vehicle body and a right rear jig on a rear side fixed by a right rear side body jig fixing part which is movable closer to and away from the vehicle body, the left side jig and the right side jig are respectively configured to be independently capable of holding each component of a side of the vehicle body and each component installed in a vehicle width direction of the vehicle body from lateral sides of the vehicle body, instead of providing a side jig that covers an entire left side or an entire right side of the vehicle body or the left side jig and the right side jig or an upper jig that is configured to be disposed at a position above a roof of the vehicle body, wherein the left side jig and the right side jig move inwardly through a side door section of the vehicle body and having an internal clamp capable of performing positioning of each said component from inside of the vehicle body in addition to having an external clamp for positioning of each said component outward of the vehicle body, and wherein each of the left front jig, the left rear jig, the right front jig, and the right rear jig independently fixes to each of the component from inside of the vehicle body.

2. The vehicle body manufacturing apparatus according to claim 1, wherein the left side jig and the right side jig each have a receiving unit that positions and pre-assembles the vehicle body according to a shape of the vehicle body, and the receiving unit is replaceable according to the vehicle shape.

3. A vehicle body manufacturing apparatus comprising:

a left side jig configured to be disposed on a left lateral side of a vehicle body essentially consisting of a left front jig on a front side fixed by a left front side body jig fixing part which is movable closer to and away from the vehicle body; and a left rear jig on a rear side fixed by a left rear side body jig fixing part which is movable closer to and away from the vehicle body; and a right side jig configured to be disposed on a right lateral side of the vehicle body essentially consisting of a right front jig on a front side fixed fay a right front side body jig fixing part which is movable closer to and away from the vehicle body and a right rear jig on a rear side fixed by a right rear side body jig fixing part which is movable closer to and away from the vehicle body, wherein the vehicle body manufacturing apparatus positions and pre-assembles the vehicle body using at least the left side jig and the right side jig, the left side jig and the right side jig are respectively configured to be independently capable of holding each component of a side of the vehicle body and each component installed in a vehicle width direction of the vehicle body from lateral sides of the vehicle body, instead of providing a side jig that covers an entire left side or an entire right side of the vehicle body or the left side jig and the right side jig or an upper jig that is configured to be disposed at a position above a roof of the vehicle body, wherein the left side jig and the right side jig move inwardly through a side door section of the vehicle body and perform positioning of each said component from inside of the vehicle body in addition to having an external clamp for positioning of each component outward of the vehicle body, and wherein each of the left front jig, the left rear jig, the right front jig, and the right rear jig independently fixes to each of the component from inside of the vehicle body.

4. The vehicle body manufacturing apparatus of claim 3, wherein the left side jig and the right side jig each have a receiving unit that positions and pre-assembles the vehicle body according to a shape of the vehicle body, and the receiving unit is replaceable according to the vehicle shape.

* * * * *